US010334890B2

(12) United States Patent
Sobah

(10) Patent No.: US 10,334,890 B2
(45) **Date of Patent: *Jul. 2, 2019**

(54) BRA AND/OR BRA PAD FOR PROVIDING THE APPEARANCE OF SYMMETRY TO ASYMMETRICAL BREASTS

(71) Applicant: Mary C. Sobah, St. Clair Shores, MI (US)

(72) Inventor: Mary C. Sobah, St. Clair Shores, MI (US)

( * ) Notice: Subject to any disclaimer, the term of this patent is extended or adjusted under 35 U.S.C. 154(b) by 266 days.

This patent is subject to a terminal disclaimer.

(21) Appl. No.: 15/198,279

(22) Filed: Jun. 30, 2016

(65) Prior Publication Data

US 2016/0302492 A1 Oct. 20, 2016

Related U.S. Application Data

(63) Continuation-in-part of application No. 13/850,483, filed on Mar. 26, 2013, now abandoned, which is a continuation of application No. 13/115,596, filed on May 25, 2011, now abandoned, which is a continuation of application No. 12/944,116, filed on Nov. 11, 2010, now Pat. No. 8,506,349, which is a continuation of application No. 12/192,615, filed on Aug. 15, 2008, now Pat. No. 7,833,083, which is a continuation of application No. 11/776,224, filed on Jul. 11, 2007, now Pat. No. 7,413,495.

(60) Provisional application No. 60/909,020, filed on Mar. 30, 2007, provisional application No. 61/449,218, filed on Mar. 4, 2011.

(51) Int. Cl.

| | |
|---|---|
| ***A41C 3/02*** | (2006.01) |
| ***A41C 3/00*** | (2006.01) |
| ***A41C 3/14*** | (2006.01) |

(52) U.S. Cl.

CPC ..... *A41C 3/0092* (2013.01); *A41C 3/0028* (2013.01); *A41C 3/0071* (2013.01); *A41C 3/146* (2013.01); *A41C 3/02* (2013.01)

(58) Field of Classification Search

CPC ..... A41C 3/00; A41C 3/148; A41C 3/146; A41C 3/144; A41C 3/10; A41C 3/0035; A41C 3/0028; A41C 3/0071

USPC ..... 450/36, 37, 39, 54–57

See application file for complete search history.

(56) References Cited

U.S. PATENT DOCUMENTS

| | | | |
|---|---|---|---|
| 2,495,307 | A | 1/1950 | Abramson |
| 2,779,943 | A | 2/1957 | Kelleher |
| 2,824,563 | A | 2/1958 | Hill |

(Continued)

FOREIGN PATENT DOCUMENTS

| | | |
|---|---|---|
| FR | 2889032 | 7/2005 |
| JP | 2003-227009 | 8/2003 |
| JP | 2004256956 A | 9/2004 |

OTHER PUBLICATIONS

Carolyn Fox, "A 'Boob Thing'", American Observer, May 18, 2007, http://observer.american.edu/021506/Boobpg1_021506.html.

(Continued)

*Primary Examiner* — Gloria M Hale

(74) *Attorney, Agent, or Firm* — Christopher P. Maiorana, PC

(57) ABSTRACT

A breast cup comprising an inner shell and an outer shell. The inner shell may have a concave shape selected from a number of available cup sizes. The outer shell may have a convex shape selected from a number of available breast cup sizes.

13 Claims, 14 Drawing Sheets

(56) References Cited

U.S. PATENT DOCUMENTS

| | | | | |
|---|---|---|---|---|
| 2,915,067 | A | 12/1959 | Bracht | |
| 3,094,125 | A | 6/1963 | Lewis | |
| 3,311,112 | A | 3/1967 | Murray | 450/1 |
| 3,392,731 | A | 7/1968 | Silverman | |
| 3,701,168 | A | 10/1972 | Balow | 3/36 |
| 3,826,266 | A | 7/1974 | Alpert | 450/11 |
| 3,950,792 | A | 4/1976 | Williams | 3/36 |
| 4,080,416 | A | 3/1978 | Howard | 264/257 |
| 4,172,002 | A | 10/1979 | Gluckin | |
| 4,185,332 | A | 1/1980 | Jahnig | 3/36 |
| 4,222,387 | A | 9/1980 | Tetu | 128/460 |
| 4,250,137 | A | 2/1981 | Riedler | 264/321 |
| 4,269,191 | A | 5/1981 | Evans | 128/488 |
| 4,369,792 | A | 1/1983 | Miller | 128/479 |
| 4,372,321 | A | 2/1983 | Robinson | |
| 4,699,144 | A | 10/1987 | Sherwood | 450/54 |
| 4,740,258 | A | 4/1988 | Breitscheidel | |
| 4,867,826 | A | 9/1989 | Wayte | |
| 5,066,302 | A | 11/1991 | Rice | |
| 5,098,330 | A * | 3/1992 | Greenberg | A41C 3/10 450/31 |
| 5,180,326 | A | 1/1993 | Williams | 450/91 |
| 5,334,082 | A | 8/1994 | Barker | 450/31 |
| 5,522,892 | A | 6/1996 | Lin | 450/39 |
| 5,690,537 | A * | 11/1997 | Kalmus | A41C 3/10 2/267 |
| 5,749,768 | A | 5/1998 | Green | 450/65 |
| 5,951,367 | A | 9/1999 | Hsu | 2/267 |
| 5,967,877 | A | 10/1999 | Howard | |
| 6,015,332 | A | 1/2000 | Lee et al. | 450/57 |
| 6,048,252 | A | 4/2000 | Sebring | 450/1 |
| 6,055,668 | A | 5/2000 | Gros et al. | 2/69 |
| 6,101,630 | A | 8/2000 | Lee | 2/57 |
| 6,110,006 | A | 8/2000 | Chen | 450/57 |
| 6,231,423 | B1 | 5/2001 | Deal et al. | 450/57 |
| 6,390,885 | B1 | 5/2002 | Brooks | 450/1 |
| 6,425,800 | B1 | 7/2002 | Huang | |
| 6,439,960 | B1 | 8/2002 | Fildan et al. | |
| 6,811,464 | B2 | 11/2004 | Li | |
| 6,881,123 | B1 | 4/2005 | Klakauskas | 450/39 |
| 6,935,921 | B1 | 8/2005 | Eudenbach et al. | 450/54 |
| 6,966,815 | B2 | 11/2005 | Weinerth | |
| 7,001,240 | B1 | 2/2006 | Huffman-Jimenez | 450/58 |
| 7,052,360 | B2 | 5/2006 | Lau | |
| 7,118,444 | B2 | 10/2006 | Newman | 450/58 |
| 7,381,113 | B2 | 6/2008 | Hori | |
| 7,413,495 | B1 | 8/2008 | Sobah-Wilhelm | 450/58 |
| 7,833,083 | B2 | 11/2010 | Sobah-Wilhelm | 450/39 |
| 8,118,639 | B1 | 2/2012 | Boon | 450/37 |
| 2002/0102913 | A1 | 8/2002 | Courtney et al. | 450/57 |
| 2004/0117895 | A1* | 6/2004 | Fortner | A41C 3/144 2/267 |
| 2004/0142633 | A1 | 7/2004 | Luk | 450/39 |
| 2005/0037687 | A1* | 2/2005 | Newman | A41C 3/0028 450/54 |
| 2006/0043636 | A1 | 3/2006 | Hsuch | 264/321 |
| 2006/0052035 | A1 | 3/2006 | Walker | |
| 2006/0079153 | A1 | 4/2006 | Davidson | 450/58 |
| 2006/0276105 | A1 | 12/2006 | Han | |
| 2007/0004315 | A1 | 1/2007 | Luk et al. | |
| 2007/0117495 | A1 | 5/2007 | Walker | |
| 2007/0161328 | A1* | 7/2007 | Munn, Jr. | A41C 3/148 450/1 |
| 2007/0270078 | A1* | 11/2007 | Henry | A41C 3/0035 450/54 |
| 2007/0289047 | A1 | 12/2007 | Fortner | 2/268 |
| 2007/0298681 | A1 | 12/2007 | Liu | |
| 2008/0032598 | A1 | 2/2008 | Bentham et al. | |
| 2011/0104984 | A1* | 5/2011 | Thaves | A41C 3/10 450/57 |
| 2011/0275279 | A1 | 11/2011 | Lin | 450/92 |
| 2012/0045966 | A1 | 2/2012 | Zhang | 450/92 |
| 2013/0165017 | A1 | 6/2013 | Liu | 450/38 |

OTHER PUBLICATIONS

"Sylene's . . . Fine Lingerie On-line", May 18, 2007, http://www.sylenes.com.

"Park Masectomy Bras", May 18, 2007, http://www.parkmastectomy.com/Merchant2/merchant.mvc?Screen=CTGY&Category_Code=BAS_MB.

"Jodee #345 Perma Form Masectomy Bra", May 18, 2007, http://www.parkmastectomy.com/Merchant2/merchant.mvc?Screen=PROD&Product_Code=Jodee_345&Category_Code=.

* cited by examiner

BRA AND/OR BRA PAD FOR PROVIDING THE APPEARANCE OF SYMMETRY TO ASYMMETRICAL BREASTS

This application relates to U.S. Ser. No. 13/850,483, filed Mar. 26, 2013, which relates to U.S. Ser. No. 13/115,596, filed May 25, 2011, which relates to U.S. Ser. No. 12/944,116, filed Nov. 11, 2010, now U.S. Pat. No. 8,506,349, which relates to U.S. Ser. No. 12/192,615, filed Aug. 15, 2008, now U.S. Pat. No. 7,833,083, which relates to U.S. Ser. No. 11/776,224, filed Jul. 11, 2007, now U.S. Pat. No. 7,413,495, which relates to U.S. Provisional Application No. 60/909,020, filed Mar. 30, 2007, each of which are hereby incorporated by reference in their entirety.

U.S. Ser. No. 13/115,596, filed May 25, 2011, claims the benefit of U.S. Provisional Application No. 61/449,218, filed Mar. 4, 2011 which is hereby incorporated by reference in its entirety.

FIELD OF THE INVENTION

The present invention relates to bra garments generally, and, more particularly, to a bra, bra pad and/or bra cup to provide the appearance of symmetry to asymmetrical breasts.

BACKGROUND OF THE INVENTION

Most or all women have some degree of breast asymmetry (i.e., un-even breasts). Even if a woman has breasts with cup sizes that differ by less than a half-cup size, such a difference can be noticeable. While many women suffer from natural breast abnormalities, other women have disfigured breasts as a result of the treatment for breast cancer or other breast surgeries. According to World Health Organization, over 1.2 million women will be diagnosed with breast cancer worldwide, many of whom will need to have a lumpectomy. According to the American Cancer Society approximately 1 out of 8 women will be diagnosed with breast cancer in the U.S. alone.

Uneven breasts have undesirable effects that can impact daily life, sexuality and confidence of affected women. While most or all women have some degree of breast asymmetry, many are suffering from abnormalities and deformities caused by a lumpectomy, a tuberous breast, Poland Syndrome or Congenital Micromastia. A lumpectomy is the surgical removal of a tumor, normally as a treatment for breast cancer. A tuberous breast occurs when the breast is narrow instead of round from the top to bottom, resembling a tube shape. Often, the areola are puffy and protrude, making the breast look abnormal. The Poland Syndrome is a birth defect characterized by underdevelopment or absence of the chest muscle. Congenital Micromastia is a medical term for a condition commonly known as small breasts.

According to the Population Reference Bureau 2005 report, there were a total of 3,209,000,000 women in the world. The total lingerie market in 2003 amounted to $29.5 billion. Bras accounted for a significant amount of total lingerie sales. Sales of lingerie are expected to increase to 31.6 billion by the year 2012. The average woman in the developed world owns a number of bras. However, there are no bras that both (i) fit abnormally shaped breasts and (ii) cause both breasts to appear to be even.

It would be desirable to make a bra and/or bra pad that provides the appearance of symmetry to asymmetrical breasts.

SUMMARY OF THE INVENTION

The present invention concerns a breast cup comprising an inner shell and an outer shell. The inner shell may have a concave shape selected from a number of available cup sizes. The outer shell may have a convex shape selected from a number of available breast cup sizes.

The objects, features and advantages of the present invention include implementing a bra and/or bra pad that may (i) provide the appearance of symmetry to asymmetrical breasts, (ii) provide padding to a smaller of the first cup or the second cup such that the first cup and the second cup have an equal outside size, (iii) provide gel to fill the void in the smaller cup, (iv) provide removable padding/gel pads and/or (v) provide gel pads that may be individually filled to a desired fullness.

BRIEF DESCRIPTION OF THE DRAWINGS

These and other objects, features and advantages of the present invention will be apparent from the following detailed description and the appended claims and drawings in which:

These and other objects, features and advantages of the present invention will be apparent from the following detailed description and the appended claims and drawings in which:

DETAILED DESCRIPTION OF THE PREFERRED EMBODIMENTS

Figure 1:
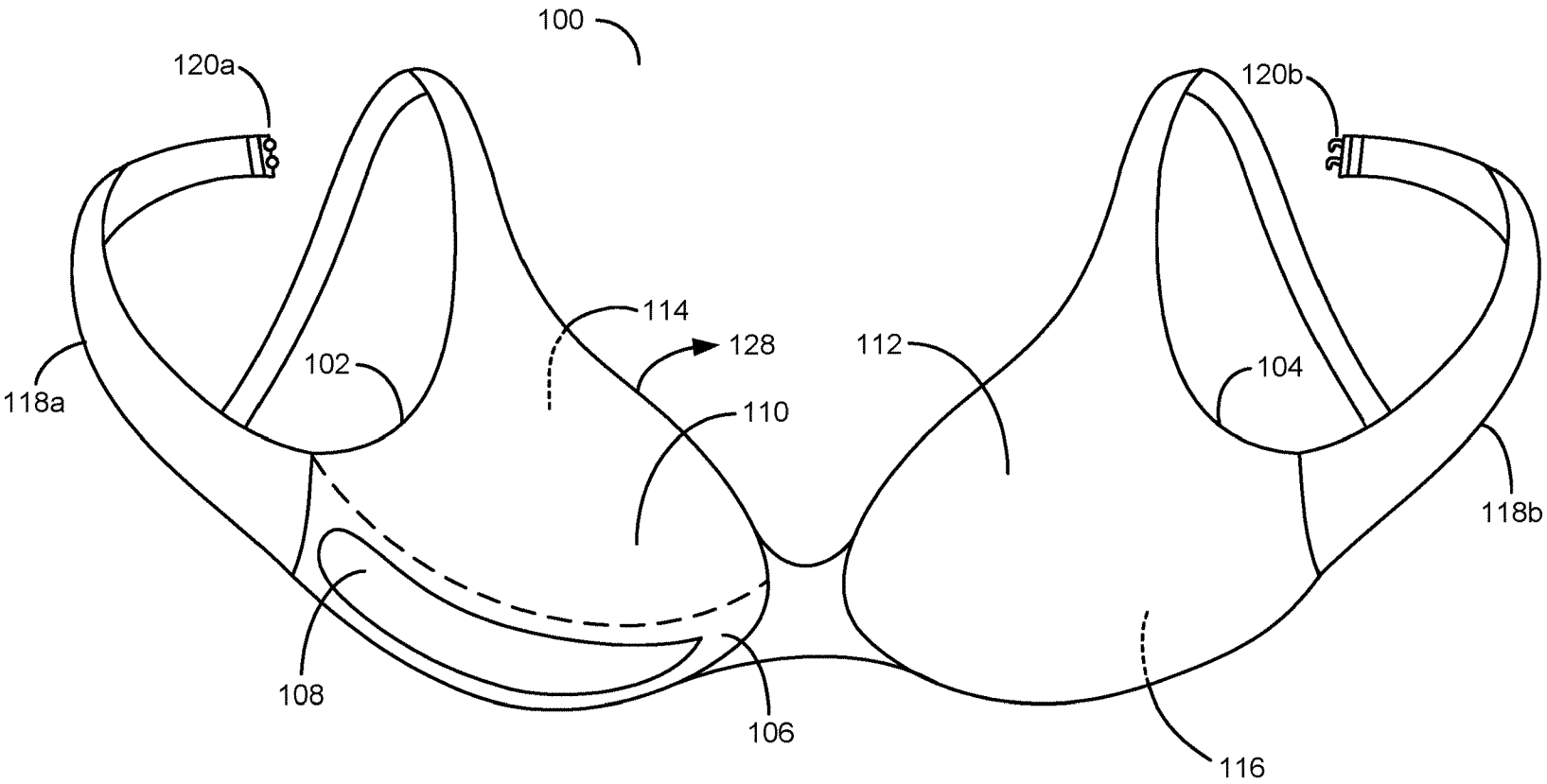
FIG. 1 is a diagram illustrating an example of a bra in accordance with the present invention.

Referring to FIG. 1, a diagram of system 100 is shown in accordance with a preferred embodiment of the present invention. The system 100 may be implemented as a bra, a sports bra, a brassier, a bikini top, a camisole, other lingerie top, or other breast covering garment. The system 100 generally comprises a cup 102 and a cup 104. The cup 102 and the cup 104 generally have the outer appearance of typical bra cups. In the example shown, the cup 104 may be implemented as a standard bra cup without enhancements. The cup 102 may be implemented as a bra cup with enhancements in accordance with the present invention. The cup 102 may be implemented to accommodate a different sized breast than a breast accommodated by the cup 104.

The cup 102 generally comprises a portion 106 and a portion 108. The portion 106 may be implemented as a pad. The portion 108 may be implemented as an enhanced portion. The portion 108 may be referred to as a cookie. The portion 108 may be filled with air, gel, foam gel, whipped gel, silicone, whipped silicone, saline or other types of non-solid substances and/or materials. The portion 106 may be formed using a solid piece of a flexible material, such as a piece of foam, a multi-ply foam piece, or other similar materials. The cup 102 may have a pre-formed outer shell 110. The cup 104 may have a pre-formed outer shell 112. The outer shell 110 and the outer shell 112 may be formed to have the same outer shape and/or dimensions. The cup 102 may have an inner shell 114. The cup 104 may have an inner shell 116. The inner shell 114 and the inner shell 116 may be different sizes and/or shapes. The cup 102 may contain the pad portion 106, the cookie portion 108 and/or other filling materials to fill the void between the inner cup 114 and the outer cup 110. In one example, the pad portion 106, the cookie portion 108 and/or other filling materials may be fused to the cup 102. However, other ways to connect the pad portion 106, the cookie portion 108, and/or the other filling materials may be implemented to meet the design criteria of a particular implementation. For example, glue and/or other suitable adhesives may be used. In general, the inner cup 114 may be formed to have a shape that accommodates a small or misshapen breast. The cup 102 may give a breast that is smaller than the other larger breast the appearance of symmetry when compared with the larger breast. The cup 102 may compensate for issues arising from surgery, birth defects and/or any other disfigurement.

In general, the cookie portion 108 may sit on or within the pad portion 106. The cookie portion 108 may be used to cause the breast to be pushed upward and over toward a center cleavage area, as shown by an arrow 128. Such enhancement may give the appearance of fullness, symmetry and a desirable shape to the breasts. Such enhancement may provide evenness to the appearance of the cleavage area, as shown by an arrow 128.

The bra 100 may also include a strap 118*a* and a strap 118*b*. The straps 118*a* and 118*b* may be connected together by a connecting device 120*a* and a connecting device 120*b*. The connecting devices 120*a* and 120*b* may be removably connected. The connecting devices 120*a* and 120*b* may be implemented as different sized clasps, rings, straps and/or any other appropriate connecting devices.

Figure 2A:
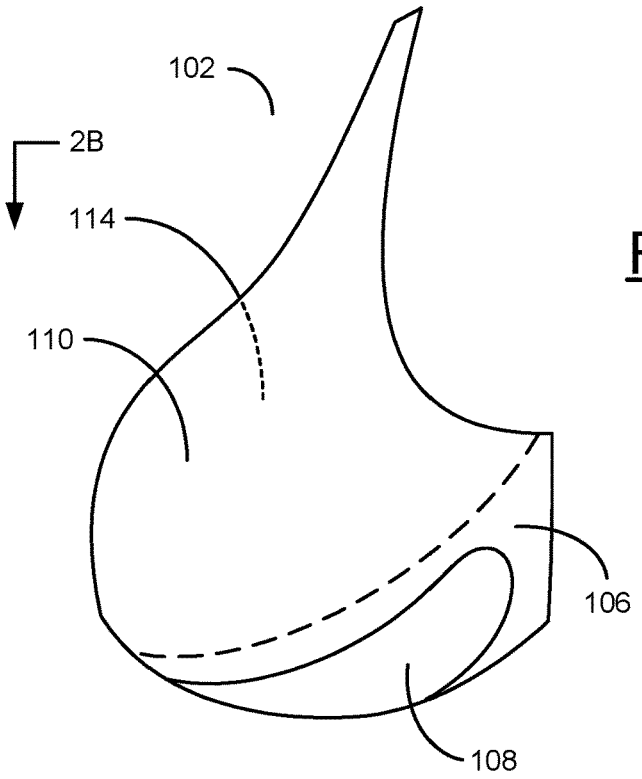
FIGS. 2*a-b* are diagrams illustrating outside views of a bra pad in accordance with the present invention.
Figure 2B:
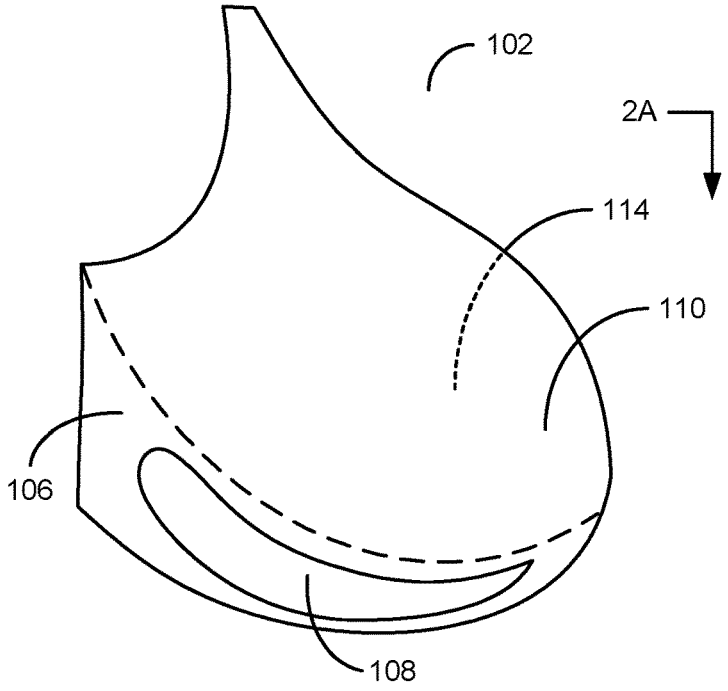

Referring to FIG. 2*a*, a side view of the cup 102 is shown. Referring to FIG. 2*b*, a front view of the cup 102 is shown. In one example, the cup 102 may be designed specifically to compensate for breast asymmetry and/or deformities as the result of surgery or birth defects. The present invention may be used to enhance one or both breasts. The cup 102 in FIGS. 2*a* and 2*b* illustrates various views of the pre-formed outer shell 110. The outer shell 110 may be designed to consistently maintain the shape and/or appearance of well-formed and/or even breasts. In one example, the outer shell 110 may be consistent with the measurements of standard cup sizes (e.g., A, B, C, D, etc.).

The pad portion 106 and the cookie portion 108 may be made of foam or other substance such as whipped foam, gel, silicone, whipped silicone or other filler. Combinations of such materials may also be implemented. The cookie portion 108 may aid in filling or conforming to particular breast asymmetries. The pad portion 106 may fill a void between the outer shell 110 and the inner shell 114. The inner shell 114 may be created by the pad portion 106. The inner shell 114 may be consistent with a standard cup size (e.g., A, B, C, D, etc.) The void may be filled with padding, gel, one or more gel pads, removable pads, fill tubes, a combination of such materials, and/or any other materials. In one example, the pad portion 106 may be fused (or secured) directly onto the inside of the outer shell 110. While fusing has been described, various processes and/or adhesives may be used to meet the design criteria of a particular implementation.

Figure 3:
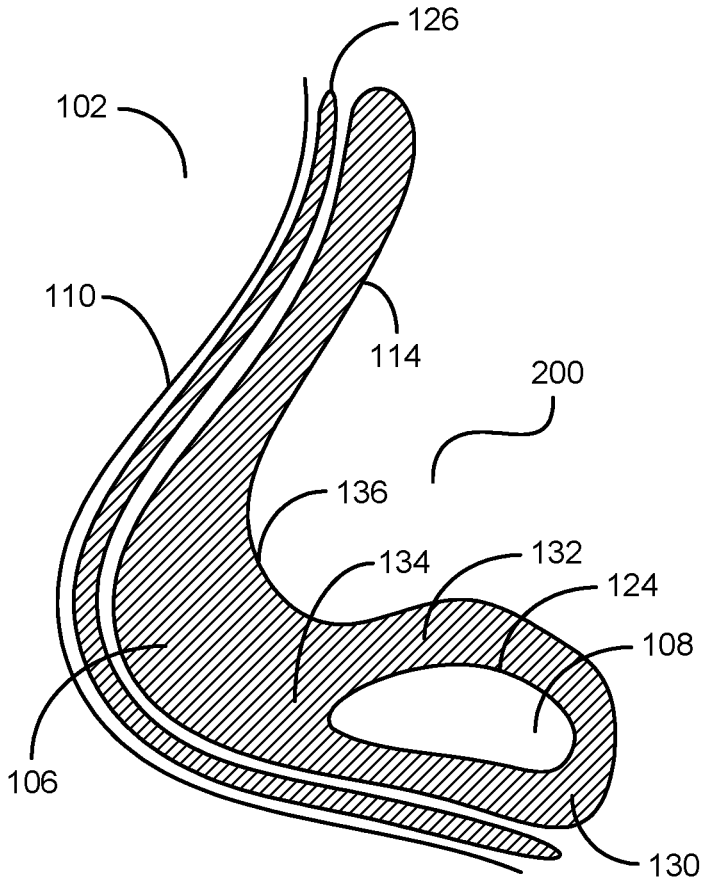
FIG. 3 is a diagram illustrating a cross sectional view of a bra pad in accordance with the present invention.

Referring to FIG. 3, a cross sectional view of the cup 102 is shown. The inner shell 114 may be formed by the pad portion 106. A breast 200 is shown within the inner shell 114. The cookie portion 108 may have a variety of shapes and/or sizes. In the example shown, the cookie portion 108 has a generally tear-dropped shape. However, other shapes may be implemented to meet the design criteria of a particular implementation. For example, the cookie portion 108 may run the length of the bottom portion 130 of the pad portion 106. In one example, the cookie portion 108 may have a protrusion 124. The protrusion 124 may be located near a portion of the cup 102 that would normally sit near the under arm (e.g., towards the inside portion 132 of the pad portion 106). In one example, the cookie portion 108 may be built into the thickest part of the pad portion 106, along the bottom portion 130. In one example, the protrusion 124 may be the same thickness as the bottom portion 130. The protrusion 124 may gradually become thinner, or may taper down towards the upper edge 134. In one example, an additional pad 126 may be implemented. The pad 126 may be located between the inner shell 114 and the outer shell 110. The pad 126 may be made from a flexible material, such as a gel, foam gel, saline, or other types of non-solid substances and/or materials.

A cookie portion 108 may aid in providing the appearance of a full, symmetrical and/or desirable shape to the breast 200. The pad portion 106 may provide a cavity 136 where the breast 200 fits. The pad portion 106 may take the shape of a smaller and/or irregularly shaped breast 200. The cookie portion 108 and/or the pad portion 106 may fill in voids caused by surgery, birth defects and/or other deformities.

In one implementation, a number of pre-formed cups 102 may be formed having a range of thicknesses and/or sizes of inner shell 114. Each of the sizes of the cups 102 may be designed to build up a smaller, misshapen, and/or irregularly shaped breast 200 to have the appearance of a similarly sized and/or shaped larger breast. The thicknesses and/or sizes of the cup 102 may be designed to a variety of ranges of thickness of size of the inner shell 114. For example, a breast having a size B-cup may be designed to have an outward appearance of a breast having a size C-cup. While a B-cup to a C-cup has been described, a variety of sized breast differences or irregularities, including variations in shape, and/or other deformities may be implemented.

Figure 4A:
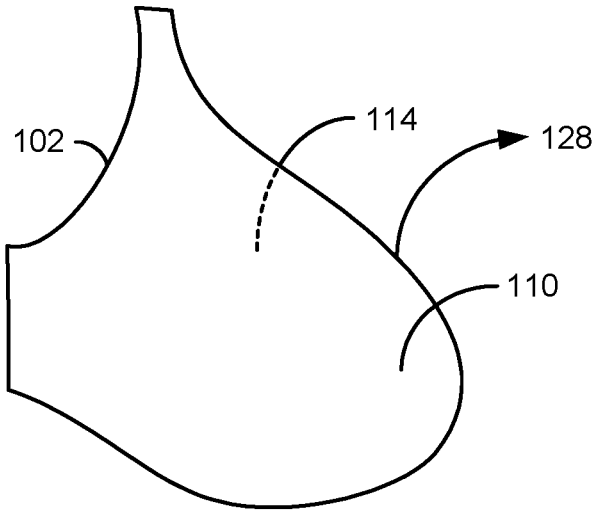
FIGS. 4*a-b* are diagrams illustrating views of an insert of a bra in accordance with the present invention.
Figure 4B:
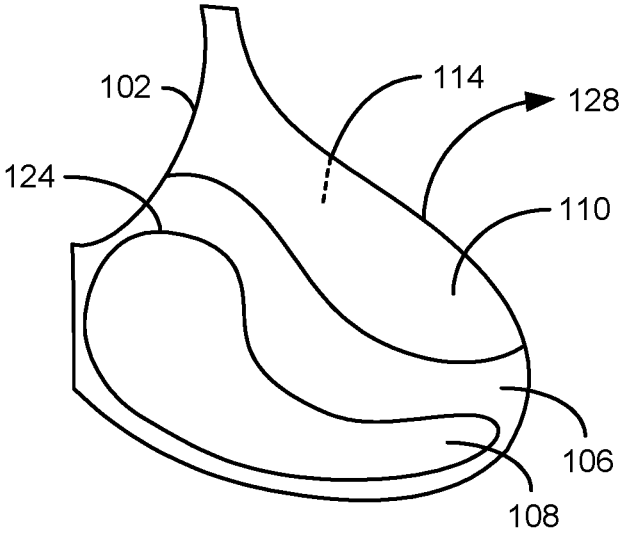

Referring to FIG. 4*a*, an outside view of the cup 102 is shown. Referring to FIG. 4*b*, an alternate inside view of the cup 102 is shown. The cup 102 may be formed having a range of thicknesses. In one example, the pad portion 106 may be thicker at the bottom section of the cup 102. The pad portion 106 may run the length of the bottom up to the top side near the under arm. In one example, the pad portion 106 may gradually become thinner going into the top, inside section of the cup 102. The pad portion 106 normally forms the inner shell 114. In one example, the thickest part of the pad portion 106 may be the cookie portion 108. The cookie portion 108 may run along the entire bottom of the cup. In one example, the cookie portion 108 may start from just under the arm. The cookie portion 108 may have a small, rounded protrusion 124 going inward towards the inside of the cup 102. The cookie portion 108 may then run along the bottom of the cup 102 in a crescent shape design. The cookie portion 108 may also provide evenness to the cleavage area, as shown by an arrow 128. The cookie portion 108 may provide symmetry to the appearance of the outer shell 110.

Figure 5:
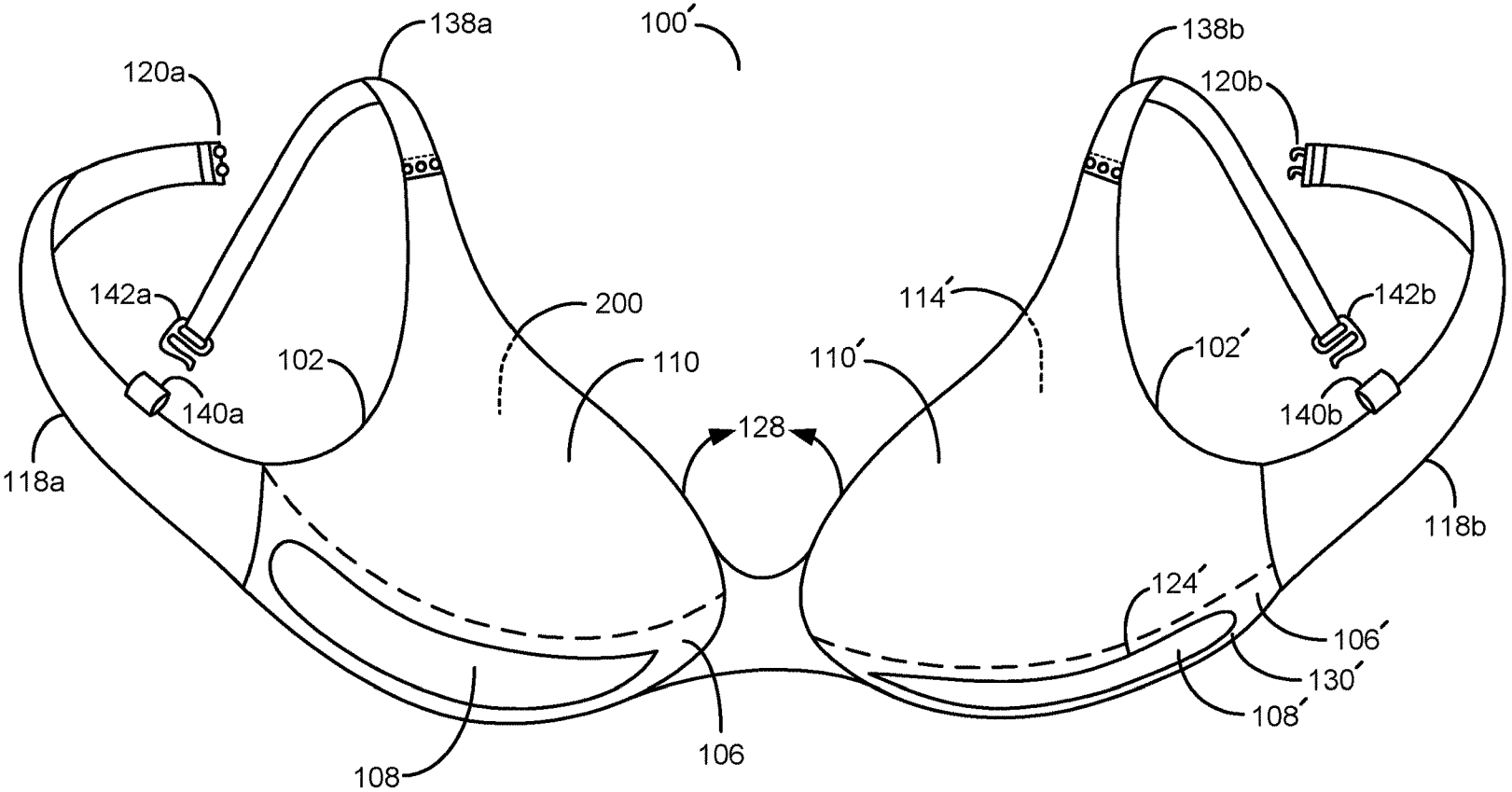
FIG. 5 is a diagram illustrating a size enhancement embodiment of the present invention.

Referring to FIG. 5, a bra 100' is shown illustrating an alternate embodiment of the present invention. In addition to the pad portion 106 and the cookie portion 108, an additional pad portion 106' and an additional cookie portion 108' may be implemented. The pad portion 106' and the cookie portion 108' may enhance the breast without a deformity. A cup 102' may implement the pad portion 106' near the bottom portion 130' of the cup 102'. The thickest part of the pad portion 106' may be implemented as the cookie portion 108'. The cookie portion 108' may run along the entire bottom of the cup 102'. The cookie portion 108' may start from just under the arm. The cookie portion 108' may have a small rounded protrusion 124' near the inside of the cup 102'. The cookie portion 108' may then run along the bottom of the cup 102'. The cookie portion 108' may have, in one example, a crescent shape design. The crescent shape of the cookie portion 108' may push the breast upward and over towards the cleavage area, as shown by an arrow 128.

The cup 102' may be designed to hold a breast that is not misshapen and/or undersized. The cup 102' may contain enough padding in pad portion 106' to increase the size of the larger breast. Similar to the cup 102, the cup 102' may have an outer shell 110' that may be larger than the inner shell 114'. The cup 102 may contain enough padding in pad portion 106 to increase the appearance of the size of the smaller breast 200 to match the enhanced size of the larger breast. The outer shell 110 may appear to be the same size as the outer shell 110'.

The straps 118*a* and 118*b* may connect in the back via connecting devices 120*a* and 120*b*. The straps 138*a* and 138*b* may connect to the bra 100' via connecting devices 142*a* and 142*b*. The connecting devices 142*a* and 142*b* may connect to the connecting device 140*a* and the connecting device 140*b*, respectively. The straps 138*a* and 138*b* may be easily removable and/or replaceable with alternative straps. For example, the straps 138*a*-138*b* may be replaced with a particular color and/or design that may accent a particular wardrobe.

Figure 6:
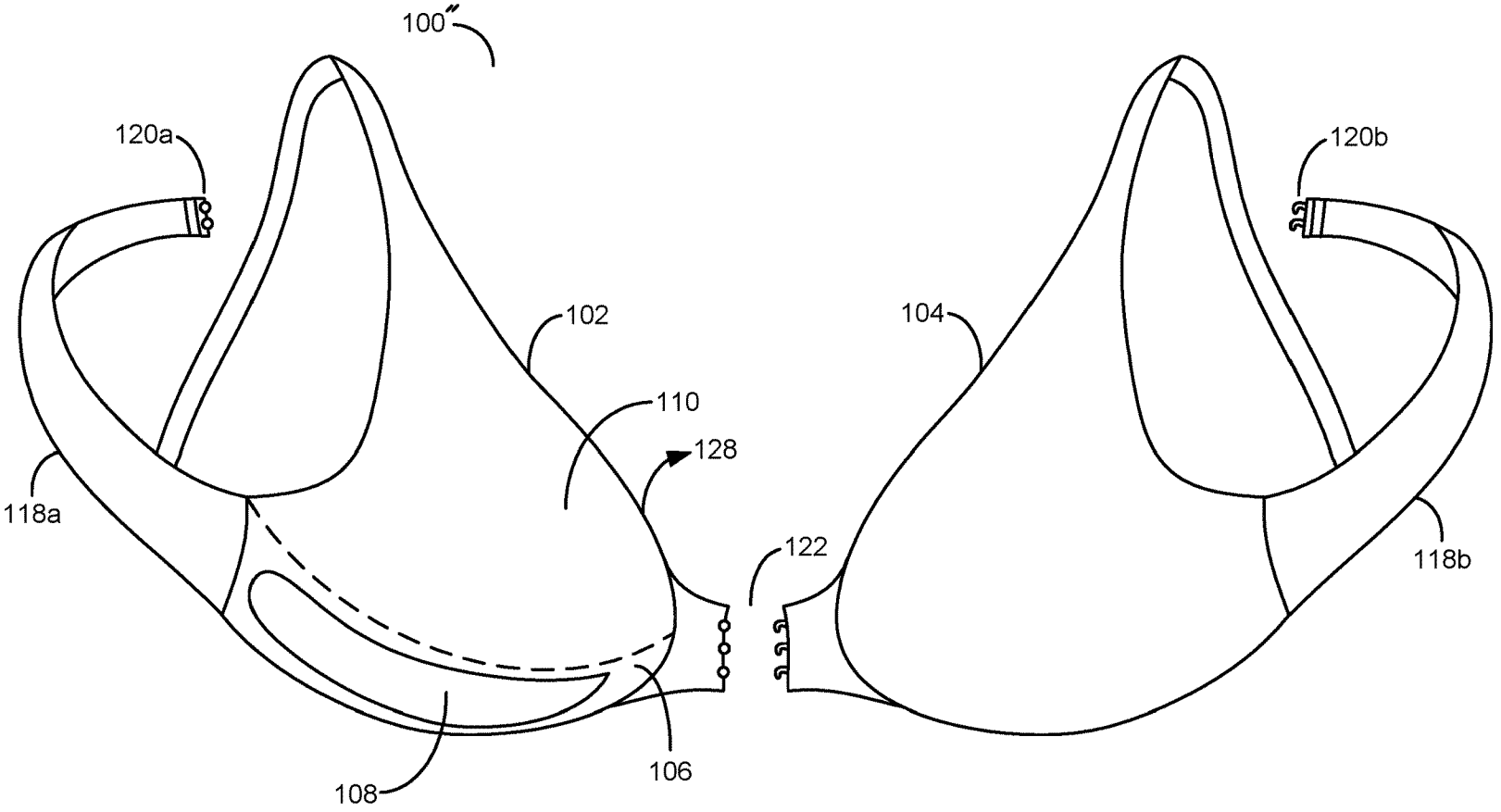
FIG. 6 is a diagram illustrating a two-piece embodiment of the present invention.

Referring to FIG. 6, a bra 100" is shown illustrating an alternate embodiment of the present invention. The bra 100" may be implemented as a two-piece design. In one example, the bra 100" may be implemented as a kit. The bra 100" may be designed as two pieces. The bra 100" may be implemented as having a cup 102 and a cup 104. The cup 102 and the cup 104 may vary in thickness. The cup 104 may also be implemented similar to the cup 102' of FIG. 5. A device 122 may be implemented towards a front portion of the bra 100". The device 122 may be used to connect the cup 102 and the cup 104. The device 122 may be implemented to provide a removable connection. The device 122 may be implemented as various sized clasps, rings, straps, and/or any other suitable connecting devices.

The device 122 may be implemented to adjust the cup 102 and the cup 104 to a specific comfort level. For example, the connecting device 122 may be adjusted to provide enhancement to the cleavage to accommodate particular needs and/or desires. The connectors 120*a* and 120*b* may connect the strap 118*a* to the strap 118*b*. The connectors 120*a* and 120*b* may be implemented as connectors similar to the device 122.

When assembled, the bra 100" may give the appearance of symmetry to otherwise asymmetrical breasts. The outer shell 110 may appear larger than the actual size of the breast being enhanced. The pad portion 106 and the cookie portion 108 may provide extra enhancement to the cup 102. The device 122 may provide an adjustment to the cleavage area, as shown by an arrow 128. The device 122 may allow adjustments to a particular level of comfort.

Figure 7:
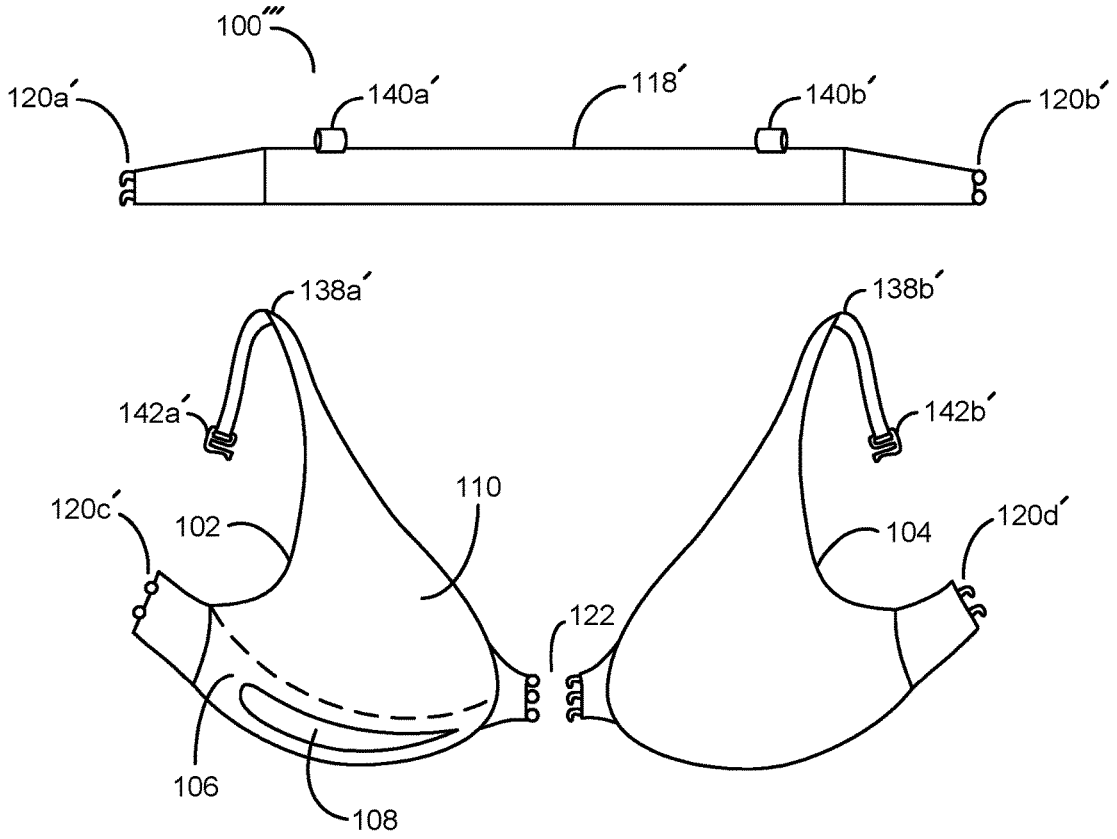
FIG. 7 is a diagram illustrating a three-piece embodiment of the present invention.

Referring to FIG. 7, a bra 100'" is shown illustrating an alternate embodiment of the present invention. The bra 100'" may be implemented as a three-piece design. In one example, the bra 100'" may be implemented as a kit. The bra 100'" may be designed as three pieces. The bra 100'" may include the cup 102, the cup 104, and a back strap 118'. The back strap 118' may be implemented separately from the cup 102 and the cup 104. The back strap 118' may be connectable to the cup 102 and to the cup 104. The cup 104 may also be implemented similar to the cup 102' of FIG. 5. The cups 102 and 104 may connect to the strap 118' through the connection devices 120*a*', 120*b*', 120*c*' and 120*d*'. The connection devices 120*a*', 120*b*', 120*c*' and 120*d*' may be adjustable to allow optimal comfort. The connector devices 120*c*' and 120*d*' (on either side of the cup 102 and the cup 104) may be sewn and/or otherwise attached to the cup 102 and the cup 104 to allow connection to the strap 118'. The connector devices 120*a*' and 120*b*' (on either side of the strap 118') may be sewn to the strap 118'. This may allow a user to have a variety of options when adjusting the size of the strap 118' to a desired comfort level. For example, a user may adjust the strap 118' to work as a size 34 band size. The strap 118' may later be adjusted to work as a size 36 band size. The device 122 may be implemented to connect the cup 102 and the cup 104. The strap 118' may include a connecting device 140*a*' and a connecting device 140*b*'. The strap 138*a*' may include a connecting device 142*a*'. The strap 138*b*' may include a connecting device 142*b*'. While the connecting device 140*a*' and the connecting device 140*b*' are shown as loops, other connectors such as claps, rings, etc. may be implemented. The connecting devices 142*a*' and 142*b*' may connect to the connecting devices 140*a*' and 140*b*'.

The bra 100'" may give the user a customized fit. The pad portion 106 and the cookie portion 108 may be implemented and adjusted to conform to a breast without changing the appearance of the outer shell 110. The outer shell 110 normally maintains a shape substantially consistent with the outer shell 112. The bra 100'" may provide a variety of adjustments. For example, the bra 100'" may provide adjustment from (i) asymmetrical to symmetrical, (ii) smaller to larger, (iii) a small amount of cleavage to a large amount of cleavage, and/or (iv) a tighter band support to a looser band support. The various adjustments may be made to accommodate the needs and/or desires of a user.

Figure 8:
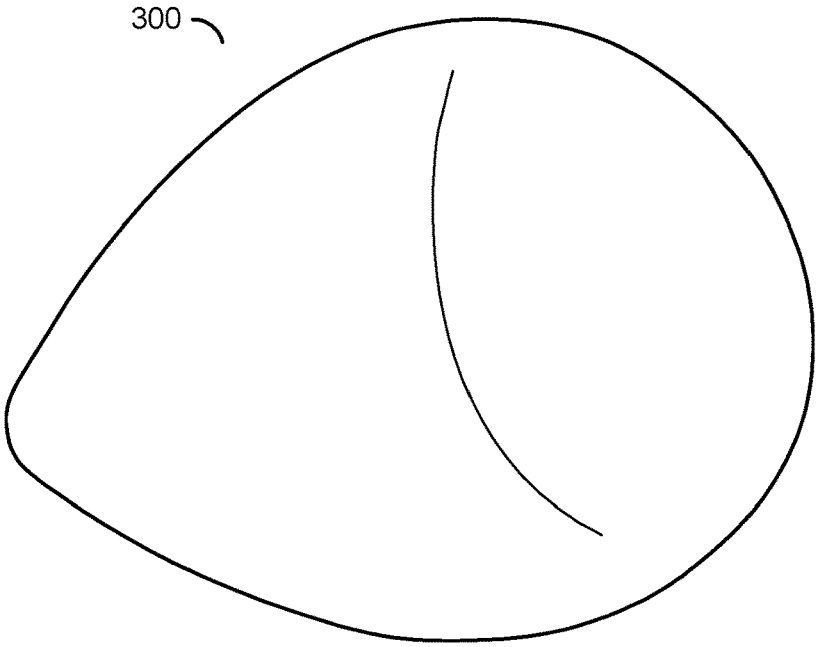
FIG. 8 is a diagram illustrating a breast cup of the present invention.

Referring to FIG. 8, a breast cup 300 is shown. In FIG. 8, the inside view of the cup 300 is generally shown. The breast cup 300 may be implemented as a single piece. An outside portion may have a convex shape selected from a number of available breast cup sizes. The outside portion, in one example, may be an outer shell. An inside portion may have a concave shape selected from a number of available cup sizes. The inner portion, in one example, may be an inner shell. In one example, the outside portion may be a different size than the inside portion. For example, the inner portion may be smaller than the outer portion.

The inner portion may comprise a crescent shape. The crescent shape may create a concave effect. The thickness of the inner portion (e.g., crescent shape) may be chosen by an end user based on the degree of asymmetry of the breasts. In one example, a thicker crescent shape may provide a smaller concave area. In general, the smaller the concave area, the smaller the inner portion cup size is compared to the outer portion cup size.

The crescent shape may comprise a void. In one example, the void may be filled with one or more gel pads. In another example, the void may be filled with gel and foam. In another example, the void may be filled with a flexible material. The crescent shape may also be configured to be filled with a core pad. In one example, the crescent shape may be filled with a plurality of core pads. The crescent shape may comprise a protrusion. The protrusion may be located just under the armpit in order to bring the breast to a center position, creating the illusion of even cleavage.

In one example, the cup 300 may be cut from a single piece of foam. In another example, the cup 300 may have a multi-piece fabrication. In one example, the outside portion and the inside portion (e.g., crescent shape) may be shaped from a single solid piece of flexible material. For example, the inner portion and the outer portion may be molded by compressing a solid piece of flexible material. In another example, flexible material may be fused to the breast cup 300. In another example, flexible material may be laminated to the breast cup 300.

Figure 9:
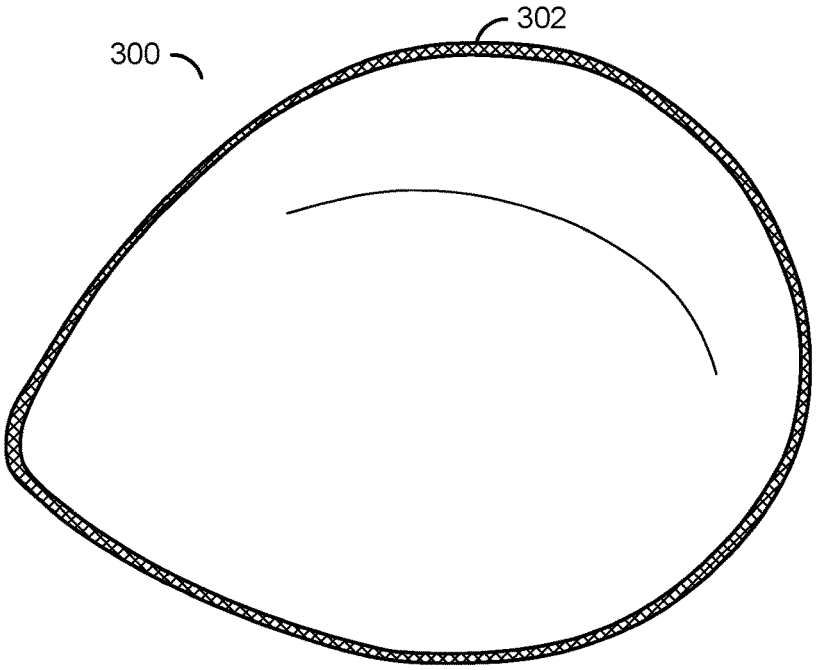
FIG. 9 is a diagram illustrating an outside view of the breast cup of the present invention.

Referring to FIG. 9, an outside view of the breast cup 300 is shown. A connection piece 302 is shown generally formed around the periphery of the cup 300. The connection piece 302 may be implemented in a number of ways. For example, the connection piece 302 may be implemented as a hook and loop fastener. In one example, the connector piece 302 may comprise a number of snap fasteners. However, the type of removable fastener may be varied to meet the design criteria of a particular implementation.

Figure 10:
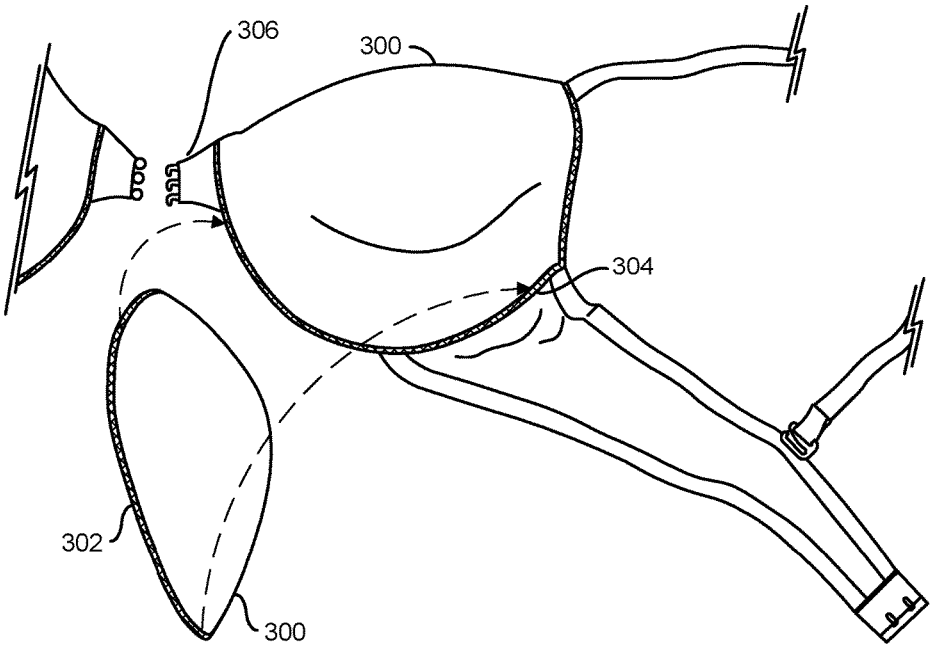
FIG. 10 is a diagram of the hook and loop fastener of the present invention.

Referring to FIG. 10, the hook and loop fastener 302 is shown connected to an opposite type of hook and loop fastener 304. The connection piece 302 and the connection piece 304 generally perform a removably connectable connection. The connection piece 304 may be attached to a separate connecting device. In one example, the connection piece 304 may be connected to a strap. The connection piece 302 may be attached to more than one connection piece 304. In one example, the connection piece 302 may be attached to a strap with a connection piece 304, a back strap with a connection piece 304, and another back strap with a connection piece 304. In one example, the connection piece 302 and the connection piece 304 may be used to attach the cup 300 to another cup 300. In one example, the breast cup 300 may be molded with a wing 306 on the side of the breast cup 300. While one wing 306 is shown, one or more wings 306 may be utilized by a manufacturer, designer, and/or end user to attach coupling devices. The wing 306 may be implemented as a small protrusion/extension of material extending from one or both of the right and/or left side of the bra cup 300. Various different connection devices (e.g., hook and eye, hook and loop, snaps, etc.) may be attached to the wing 306 to allow attachment to various straps, etc.

Figure 11:
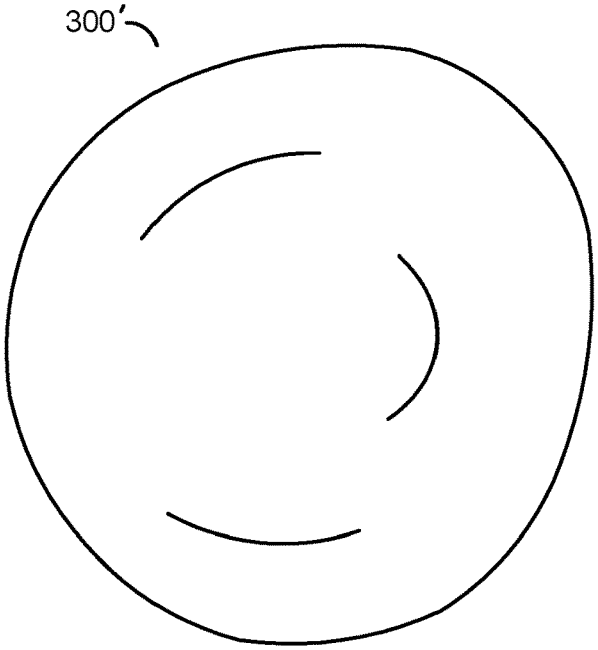
FIG. 11 is another diagram illustrating the breast cup of the present invention.
Figure 12:
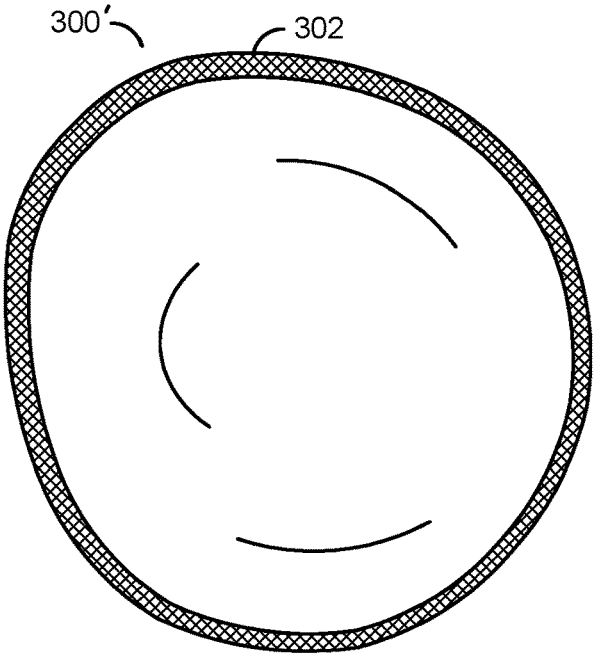
FIG. 12 is an alternate view of the breast cup of the present invention.

Referring to FIG. 11, an example of the cup 300' is shown. FIG. 11 generally illustrates an outside of the cup 300'. Referring to FIG. 12, an alternate view of the cup 300' is shown. In FIG. 12, the connection piece 302 is generally shown on the inside of the cup. In one example, the connection piece 302 may be an adherent bordering. In one example, the adherent bordering may be located on the convex outside portion. In another example, the adherent bordering may be located on the concave inner portion. FIG. 12 shows a view of the inside of the cup.

Figure 13:
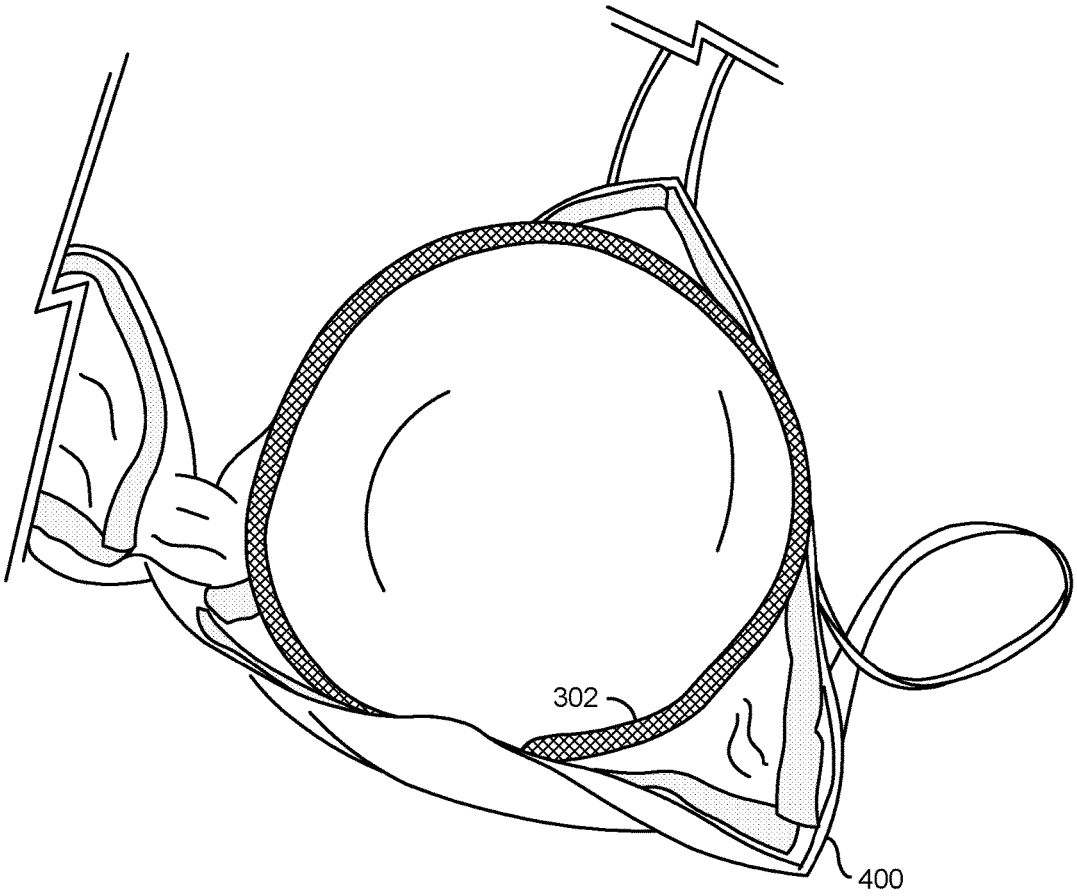
FIG. 13 is a diagram illustrating how a garment connects to the breast cup of the present invention.

Referring to FIG. 13, a diagram illustrating how a garment 400 connects to the cup 300. In one example, the garment 400 may be a breast covering apparatus. In one example, the connection piece 302 may be an adherent bordering. The connection piece 302 may be utilized to connect the cup 300 to the interior concave segment of the garment 400.

Figure 14:
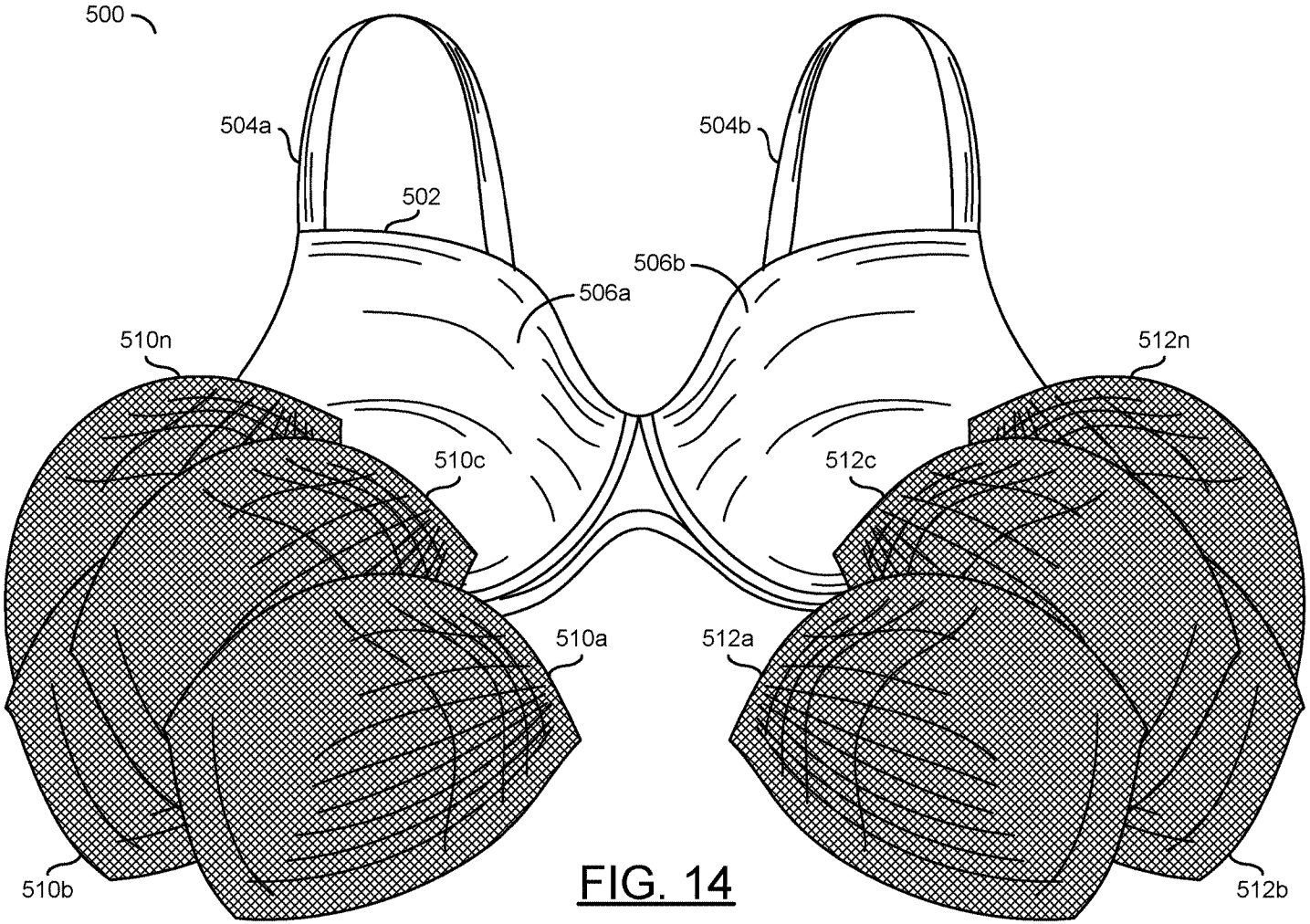
FIG. 14 is a diagram illustrating a breast cup and garment kit.

Referring to FIG. 14, a diagram illustrating a breast cup and garment kit 500 is shown. The breast cup and garment kit 500 may comprise a breast covering garment (e.g., a bra) 502. A front (or outer) view of the bra 502 is shown.

The bra 502 may comprise a shoulder strap 504*a* and a shoulder strap 504*b*. The shoulder straps 504*a*-504*b* may connect to a backside of the bra 502 (to be described in association with FIG. 15). The shoulder straps 504*a* and 504*b* may be easily removable and/or replaceable with alternative straps. For example, the shoulder straps 504*a*-504*b* may be replaced with a particular color and/or design that may accent a particular wardrobe. The shoulder straps 504*a*-504*b* may be optional (e.g., the bra 502 may be strapless).

The bra 502 may comprise a right breast cup 506*a* and a left breast cup 506*b*. The right breast cup 506*a* and the left breast cup 506*b* generally have the outer appearance of typical bra cups. The size, shape, color, style and/or material of the right breast cup 506*a* and/or the left breast cup 506*b* may be varied according to the design criteria of a particular implementation.

The breast cup and garment kit 500 may comprise an array of right breast cup inserts 510*a*-510*n* and an array of left breast cup inserts 512*a*-512*n*. The array of right breast cup inserts 510*a*-510*n* may be designed to fit the right breast cup 506*a*. The array of left breast cup inserts 512*a*-512*n* may be designed to fit the left breast cup 506*b*. In some embodiments, the right breast cup inserts 510*a*-510*n* and/or the left breast cup inserts 512*a*-512*n* may be designed to fit the right breast cup 506*a* and the left breast cup 506*b* (e.g., the right breast cup inserts 510*a*-510*n* and the left breast cup inserts 512*a*-512*n* may implement a universal fit). The array of right breast cup inserts 510*a*-510*n* and the array of left breast cup inserts 512*a*-512*n* may be designed to provide support and/or shape for the right breast cup 506*a* and the left breast cup 506*b*, respectively. For example, the right breast cup 506*a* and/or the left breast cup 506*b* may be a relatively loose fabric until one of the right breast cup inserts 510*a*-510*n* and/or one of the left breast cup inserts 512*a*-512*n* are inserted.

The array of right breast cup inserts 510*a*-510*n* and the array of left breast cup inserts 512*a*-512*n* may each comprise a number of inserts. Generally, at least two inserts are selected (e.g., one insert from the array of right breast cup inserts 510*a*-510*n* and one insert from the array of left breast cup inserts 512*a*-512*n*). Each of the inserts 510*a*-510*n* and 512*a*-512*n* may be a different shape and/or size. Generally, the size of the inserts 510*a*-510*n* and/or 512*a*-512*n* are standard breast cup sizes. In an example, the insert 510*a* may be a right breast cup size A. In another example, the insert 512*a* may be a left breast cup size A. In yet another example, the insert 510*b* may be a right breast cup size B. In still another example, the insert 512*c* may be a left breast cup size B. The number and/or sizes of the inserts 510*a*-510*b* and/or 512*a*-512*n* may be varied according to the design criteria of a particular implementation.

The breast cup and garment kit 500 may comprise at least two of the inserts 510*a*-510*n* and 512*a*-512*n* (e.g., at least one of the inserts 510*a*-510*n* and at least one of the inserts 512*a*-512*n*). The breast cup and garment kit 500 may enable a wearer to use one insert for the right breast cup 506*a* and one insert for the left breast cup 506*b*. The breast cup and garment kit 500 may have more than two of the inserts 510*a*-510*n* and/or 512*a*-512*n* and/or additional inserts may be provided (e.g., additional inserts 510*a*-510*n* and/or 512*a*-512*n* may be purchased separately).

The wearer may swap out one of the right breast cup inserts 510*a*-510*n* for another one of the right breast cup inserts 510*a*-510*n*. The wearer may swap out one of the left breast cup inserts 512*a*-512*n* for another one of the left breast cup inserts 512*a*-512*n*. By swapping out the breast cup inserts 510*a*-510*n* and/or 512*a*-512*n* the wearer may select inserts having the desired shape and/or size. Swapping out the breast cup inserts 510*a*-510*n* and/or 512*a*-512*n* may enable a one size fits all implementation for the breast cup and garment kit 500.

The right breast cup inserts 510*a*-510*n* and/or the left breast cup inserts 512*a*-512*n* may have a similar implementation as the breast cup 300 (described in association with FIGS. 8-13). In an example, the right breast cup inserts 510*a*-510*n* and/or the left breast cup inserts 512*a*-512*n* may each be implemented as a single piece. An outside portion of the breast cup inserts 510*a*-510*n* and/or 512*a*-512*n* may have a convex shape selected from a number of available breast cup sizes. The outside portion, in one example, may be an outer shell (or surface). An inside portion may have a concave shape selected from a number of available cup sizes. The inner portion, in one example, may be an inner shell (or surface).

In one example, the outside portion may be a different size than the inside portion. For example, the inner portion may be smaller than the outer portion. In another example, the outside portion and the inside portion (e.g., crescent shape) may be shaped from a single solid piece of flexible material. For example, the inner portion and the outer portion may be molded by compressing a solid piece of flexible material. In another example, a flexible material may be fused to the breast cup inserts 510*a*-510*n* and/or 512*a*-512*n*. Generally, the inner portion and the outer portion of each of the breast cup inserts 510*a*-510*n* and/or 512*a*-512*n* may be sized and/or shaped to provide a symmetrical appearance from the outside (e.g., when viewing the bra 502) while providing support and/or comfort for breasts having different (or asymmetrical) shapes and/or sizes (e.g., when wearing the bra 502).

Figure 15:
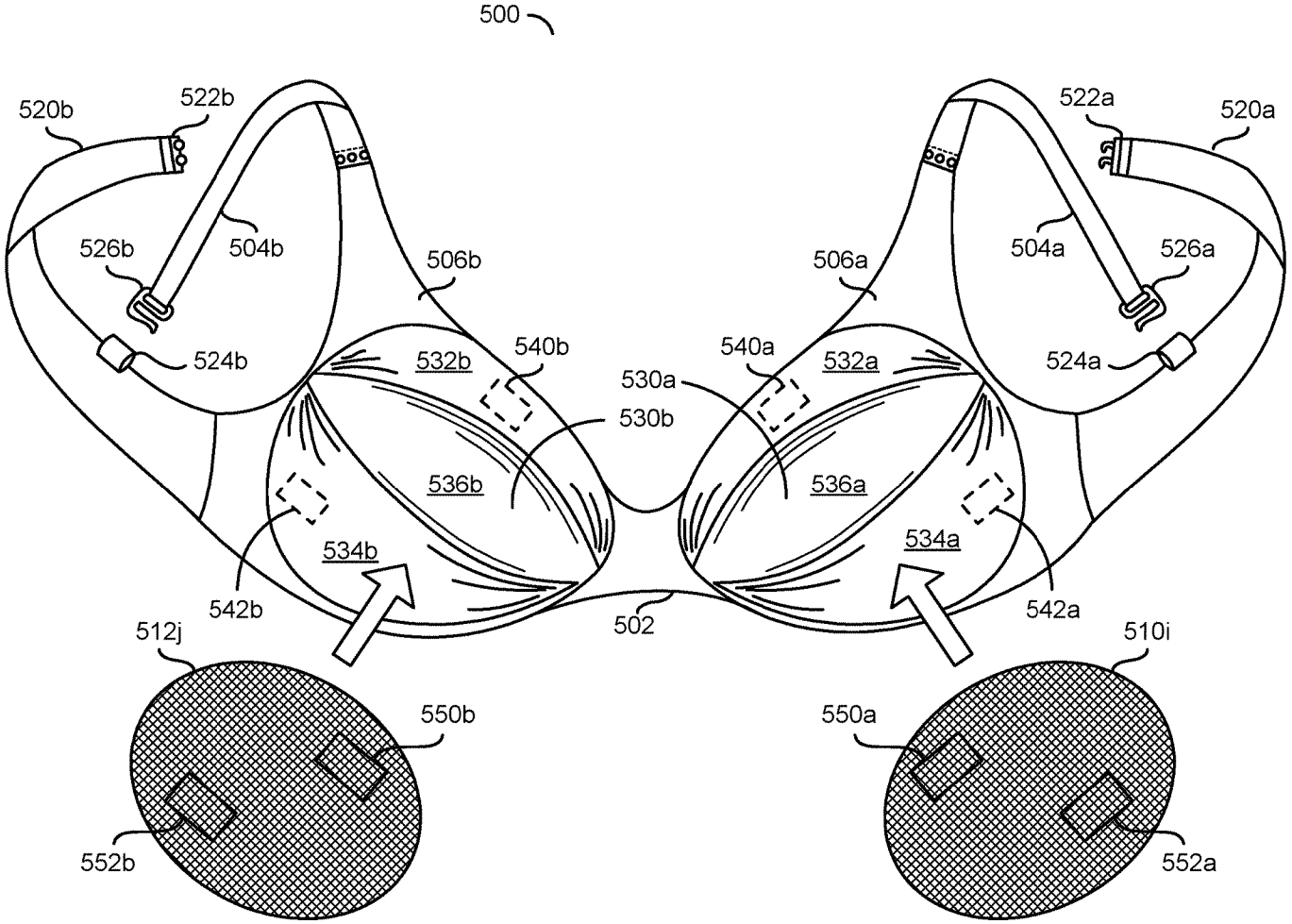
FIG. 15 is a diagram illustrating breast cup slots.

Referring to FIG. 15, a diagram illustrating breast cup slots 530*a*-530*b* is shown. A back (or inner) view of the bra 502 is shown. The bra 502 may comprise the shoulder straps 504*a*-504*b*, the right breast cup 506*a*, the left breast cup 506*b*, a right strap portion 520*a*, a left strap portion 520*b*, strap connecting devices 522*a*-522*b*, shoulder strap connecting devices 524*a*-524*b*, shoulder strap end connecting devices 526*a*-526*b*, a right breast cup slot 530*a* and/or a left breast cup slot 530*b*.

The shoulder straps 504*a* and 504*b* may connect to the bra 502 via the shoulder strap end connecting devices 526*a* and 526*b*. The shoulder straps 504*a* and 504*b* may be easily removable and/or replaceable with alternative straps. In an example, the shoulder straps 504*a*-504*b* may be replaced with a particular color and/or design that may accent a particular wardrobe. The shoulder strap end connecting devices 526*a* and 526*b* may be located at an end of the shoulder straps 504*a*-504*b*. The shoulder strap end connecting devices 526*a*-526*b* may connect to the shoulder strap connecting devices 524*a* and 526*b*, respectively.

The right shoulder strap connecting device 524*a* may be located on the right strap portion 520*a*. The left shoulder strap connecting device 524*b* may be located on the left strap portion 520*b*. In the example shown, the shoulder strap end connecting devices 526*a*-526*b* may be implemented as hooks and the shoulder strap connecting devices 524*a*-524*b* may be implemented as loops. In another example, the shoulder strap end connecting devices 526*a*-526*b* may be implemented as loops and the shoulder strap connecting devices 524*a*-524*b* may be implemented as hooks. Other types of connections may be implemented for the shoulder strap connecting devices 524*a*-524*b* and/or the shoulder strap end connecting devices 526*a*-526*b* (e.g., Velcro, stitching, clips, ties, rings, etc.).

The right strap portion 520*a* and the left strap portion 520*b* may be connected together by the strap connecting device 522*a* and the strap connecting device 522*b*. The strap connecting devices 522*a* and 522*b* may be removably connected. The strap connecting devices 522*a* and 522*b* may be implemented as different sized clasps, rings, straps and/or any other appropriate connecting devices. A length of the right strap portion 520*a* and/or the left strap portion 520*b* may be adjustable.

The right breast cup 506*a* may comprise the right breast cup slot 530*a*. The left breast cup 506*b* may comprise the left breast cup slot 530*b*. The right breast cup slot 530*a* may comprise a top fabric portion 532*a*, a bottom fabric portion 534*a* and an opening 536*a*. Similarly, the left breast cup slot 530*b* may comprise a top fabric portion 532*b*, a bottom fabric portion 534*b* and an opening 536*b*. The top fabric portions 532*a*-532*b* and/or the bottom fabric portions 534*a*-534*b* may be implemented as flaps (or lips). In one example, the top fabric portions 532*a*-532*b* and/or the bottom fabric portions 534*a*-534*b* may comprise a cotton material. In another example, the top fabric portions 532*a*-532*b* and/or the bottom fabric portions 534*a*-534*b* may comprise a silk material. In yet another example, the top fabric portions 532*a*-532*b* and/or the bottom fabric portions 534*a*-534*b* may comprise a polyester material. The slots 530*a*-530*b* may implement an open pocket. The type of material used for the top fabric portions 532*a*-532*b* and/or the bottom fabric portions 534*a*-534*b* may be varied according to the design criteria of a particular implementation.

The right opening 536*a* of the right breast cup slot 530*a* may provide space (or recess) to insert one of the right breast cup inserts 510*a*-510*n*. In the example shown, the right breast cup insert 510*i* is shown outside the right breast cup slot 530*a*. The left opening 536*b* of the left breast cup slot 530*b* may provide space (or recess) to insert one of the left breast cup inserts 512*a*-512*n*. In the example shown, the left breast cup insert 512*j* is shown outside the left breast cup slot 530*b*. In an example, the size of the outer surface of the right breast cup insert 510*i* and the size of the outer surface of the left breast cup insert 512*j* may be the same to provide an appearance of symmetry when viewing from the front of the bra 502 and the size of the inner surface of the right breast cup insert 510*i* and the size of the inner surface of the left breast cup insert 512*j* may be different sizes to provide comfort and support for the breasts (e.g., asymmetrical breasts) of the wearer of the bra 502.

The openings 536*a*-536*b* may enable the breast cup inserts 510*i* and 512*j* to be removably inserted into the breast cup slots 530*a*-530*b*. The top fabric portions 532*a*-532*b* and/or the bottom fabric portions 534*a*-534*b* may provide support and/or structure to hold the breast cup inserts 510*i* and 512*j* in place. In an example, the breast cup insert 510*i* may slide into the opening 536*a* and be held in place by the top flap (or lip) 532*a* and the bottom flap (or lip) 534*a*. The arrangement of the top fabric portions 532*a*-532*b*, the bottom fabric portions 534*a*-534*b* and/or the openings 536*a*-536*b* may be varied according to the design criteria of a particular implementation.

In one example, the bottom fabric portions 534*a*-534*b* may be larger than the top fabric portions 532*a*-532*b* (e.g., the top fabric portions 532*a*-532*b* may be a flap cover over the openings 536*a*-536*b* and the breast cup inserts 510*i* and 512*j* may be supported by the bottom fabric portions 534*a*-534*b*). In another example, the top fabric portions 532*a*-532*b* may be optional and the openings 536*a*-536*b* may be at the top of the slots 530*a*-530*b* (e.g., the breast cup inserts 510*i* and 512*j* may be inserted from a top of the slots 530*a*-530*b* and supported by the bottom fabric portions 534*a*-534*b* for a pocket implementation). In yet another example, the top fabric portions 532*a*-532*b* and the bottom fabric portions 534*a*-534*b* may not entirely cover the breast cup inserts 510*i* and 512*j* (e.g., the top flap 532*a* and the bottom flap 534*b* may be shorter than the breast cup insert 510*i* and a middle portion of the breast cup inserts 510*i* and 510*j* may be exposed).

In some embodiments, the top flaps 532*a*-532*b* and/or the bottom flaps 534*a*-534*b* may be rigid and/or stiff. In an example, the breast cup inserts 510*a*-510*n* and/or 512*a*-512*n* may be supported (e.g., held in place) by the rigidness of the top flaps 532*a*-532*b* and/or the bottom flaps 534*a*-534*b*. In some embodiments, the top flaps 532*a*-532*b* and/or the bottom flaps 534*a*-534*b* may be soft and/or flexible. In an example, soft and/or flexible top flaps 532*a*-532*b* and/or bottom flaps 534*a*-534*b* may be more comfortable but provide less structure for the breast cup inserts 510*a*-510*n* and/or 512*a*-512*n*. The breast cup and garment kit 500 may be available in a range of rigidness and/or softness.

Optionally, the top fabric portions 532*a* and 532*b* may further comprise an adherent 540*a* and an adherent 540*b*, respectively. Similarly, the bottom fabric portions 534*a* and 534*b* may optionally further comprise an adherent 542*a* and an adherent 542*b*, respectively. The adherents 540*a*-540*b* may be on an inside surface of the top fabric portions 532*a*-532*b* (e.g., between the top fabric portions 532*a*-532*b* and the openings 536*a*-536*b* and not exposed to the breast of the wearer). Similarly, the adherents 542*a*-542*b* may be on an inside surface of the bottom fabric portions 534*a*-534*b* (e.g., between the bottom fabric portions 534*a*-534*b* and the openings 536*a*-536*b* and not exposed to the breast of the wearer). The location of the adherents 540*a*-540*b* and/or 542*a*-542*b* may be varied according to the design criteria of a particular implementation.

The adherents 540*a*-540*b* and/or 542*a*-542*b* may be implemented to removably attach the breast cup inserts 510*a*-510*n* and/or 512*a*-512*n* to the breast cup slots 530*a*-530*b*. The adherents 540*a*-540*b* and/or 542*a*-542*b* may prevent the breast cup inserts 510*a*-510*n* and/or 512*a*-512*n* from slipping, sliding and/or shifting out of the breast cup slots 530*a*-530*b*. In one example, the adherents 540*a*-540*b* and/or 542*a*-542*b* may be implemented as a glue and/or adhesive tape. In another example, the adherents 540*a*-540*b* and/or 542*a*-542*b* may be implemented using hook and loop fasteners (e.g., Velcro). In yet another example, the adherents 540*a*-540*b* and/or 542*a*-542*b* may be implemented as snap buttons. The type of the adherents 540*a*-540*b* and/or 542*a*-542*b* may be varied according to the design criteria of a particular implementation.

A breast cup adherent 550*a* and/or a breast cup adherent 552*a* may be optionally implemented on the right breast cup inserts 510*a*-510*n*. Similarly, a breast cup adherent 550*b* and/or a breast cup adherent 552*b* may be optionally implemented on the left breast cup inserts 512*a*-512*n*. The breast cup adherents 550*a*-550*b* and/or 552*a*-552*b* may be used to adhere to the corresponding adherents 540*a*-540*b* and/or 542*a*-542*b*. The breast cup adherent 550*a* on the right breast cup insert 510*i* generally lines up with the adherent 540*a* on the inside of the top flap 532*a* of the right breast cup slot 530*a*. The breast cup adherent 552*a* on the right breast cup insert 510*i* generally lines up with the adherent 542*a* on the inside of the bottom flap 534*a* of the right breast cup slot 530*a*. Similarly, the breast cup adherents 550*b* and 552*b* generally line up with the adherent 540*b* and 542*b* on the inside of the top flap 532*b* and the bottom flap 534*b*, respectively, of the left breast cup slot 530*b*. For example, for hook and loop fasteners, the adherent 540*a* may be the hook portion and the loop portion may be the breast cup adherent 550*a*. In some embodiments, the breast cup adherents 550*a*-550*b* and/or 552*a*-552*b* may be one-time use and/or limited use (e.g., need replacing after an amount of usage). For example, the breast cup inserts 510*a*-510*n* and/or 512*a*-512*n* may be disposable (e.g., one-time use and/or limited use).

Figure 16:
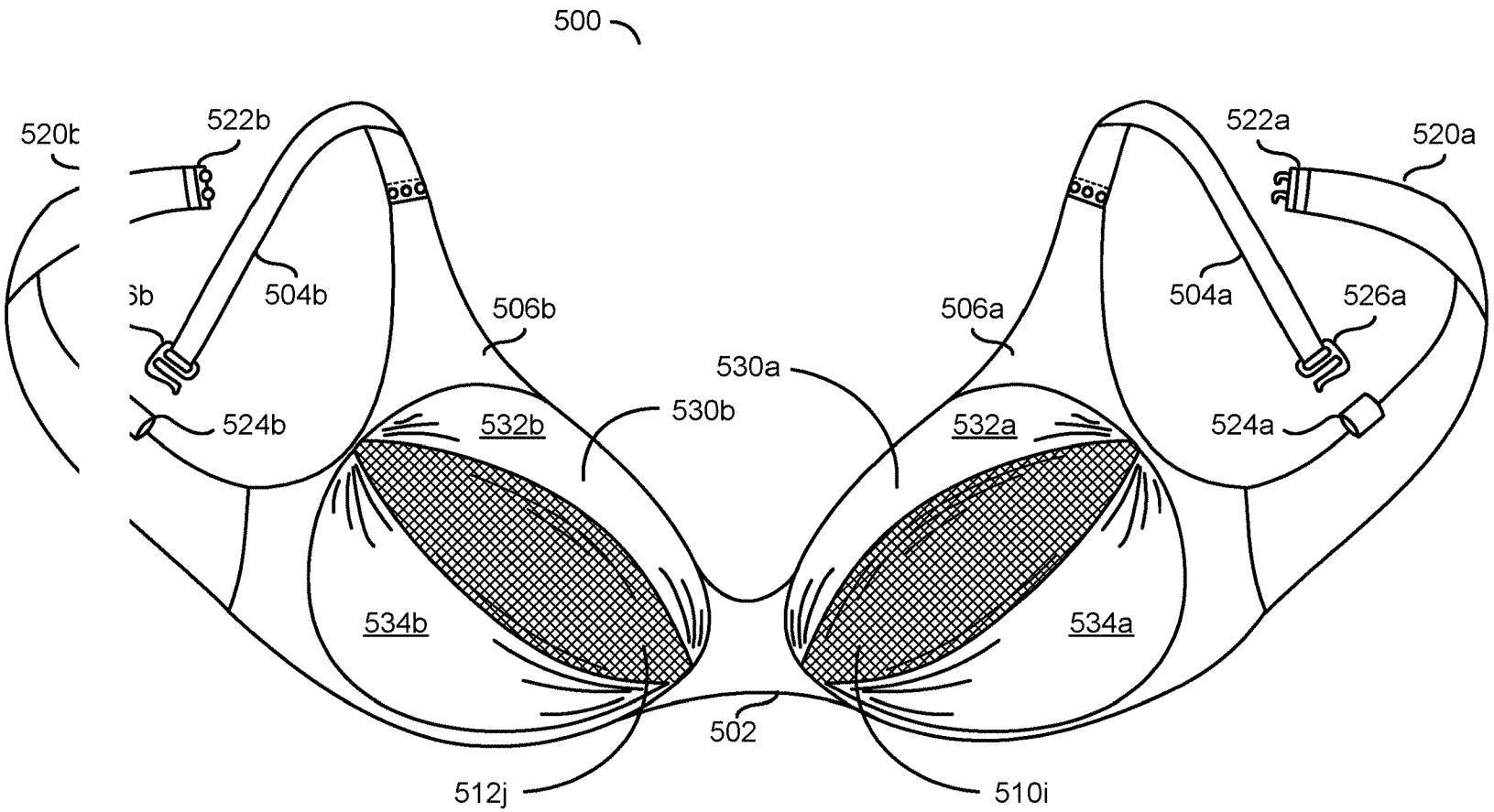
FIG. 16 is a diagram illustrating breast cup inserts inserted in slots of a garment.

Referring to FIG. 16, a diagram illustrating the breast cup inserts 510*i* and 512*j* inserted in the slots 530*a*-530*b* of the garment 502 is shown. A back (or inner) view of the bra 502 is shown. The right breast cup insert 510*i* is shown inserted in (e.g., removably attached to) the right breast cup slot 530*a*. The left breast cup insert 512*j* is shown inserted in (e.g., removably attached to) the left breast cup slot 530*b*. At least two of the breast cups 510*a*-510*n* and 512*a*-512*n* may be removably inserted into an interior of the bra 502.

When the breast cup inserts 510*a*-510*n* and/or 512*a*-512*n* are inserted in the breast cup slots 530*a*-530*b* (e.g., placed in the openings 536*a*-536*b*), the breast cup inserts 510*a*-510*n* and/or 512*a*-512*n* may be held in place by the top fabric portions 532*a*-532*b* and/or the bottom fabric portions 534*a*-534*b*. The top fabric portions 532*a*-532*b* and/or the bottom fabric portions 534*a*-534*b* may provide sufficient material to cover the openings 536*a*-536*b* and/or the breast cup inserts 510*a*-510*n* and/or 512*a*-512*n*. For example, the top fabric portions 532*a*-532*b* and/or the bottom fabric portions 534*a*-534*b* may provide sufficient material to be overlapped on each other.

Overlapping the top fabric portions 532*a*-532*b* and/or the bottom fabric portions 534*a*-534*b* may provide additional comfort. In an example, the top fabric portions 532*a*-532*b* and/or the bottom fabric portions 534*a*-534*b* may provide a barrier between the breast of the wearer and the breast cup inserts 510*a*-510*n* and/or 512*a*-512*n*. For example, the top fabric portions 532*a*-532*b* and/or the bottom fabric portions 534*a*-534*b* may comprise a breathable and/or comfortable material. The top fabric portions 532*a*-532*b* and/or the bottom fabric portions 534*a*-534*b* may prevent discomfort caused by the breast cup inserts 510*a*-510*n* and/or 512*a*-512*n* when worn directly against skin. The top fabric portions 532*a*-532*b* and/or the bottom fabric portions 534*a*-534*b* may enable the material of the breast cup inserts 510*a*-510*n* and/or 512*a*-512*n* to be varied without affecting a comfort of the wearer.

While the invention has been particularly shown and described with reference to the preferred embodiments thereof, it should be understood that variations in form and details of the preferred embodiments such as, but not limited to, modifications, equivalents and substitutions for components and/or additions to components of the specifically described embodiments of the invention, may be made by those skilled in the art without departing from the spirit and scope of the invention as set forth in the appended claims. Persons who possess such skill will also recognize that the foregoing description is merely illustrative and not intended to limit any of the ensuing claims to any particular narrow interpretation of form and details.

The invention claimed is:

1. A breast apparatus comprising:

a first breast cup comprising (i) a first inner surface having a concave shape and (ii) a first outer surface having a convex shape, wherein said first inner surface and said first outer surface are both molded by compressing a single solid piece of flexible material; and a second breast cup comprising (i) a second inner surface having said concave shape and (ii) a second outer surface having said convex shape, wherein (a) said second inner surface and said second outer surface are both molded by compressing a single solid piece of flexible material, (b) said concave shape is selected from a number of standard breast cup sizes, (c) said convex shape is selected from a number of available breast cup sizes, (d) first breast cup and said second breast cup are each removably inserted into an interior of a breast covering garment, (e) said first breast cup and said second breast cup each include an adherent, (f) said adherent of said first breast cup is configured to removably attach said first breast cup to said interior of said breast covering garment via a first slot and (g) said adherent of said second breast cup is configured to removably attach and said second breast cup to said interior of said breast covering garment via a second slot.

2. A breast apparatus comprising:

a first breast cup;

a second breast cup; and a breast covering garment comprising a first slot and a second slot, wherein (a) said first breast cup and said second breast cup each comprise (i) an inner surface having a concave shape and (ii) an outer surface having a convex shape, (b) said concave shape is selected from a number of standard breast cup sizes, (c) said convex shape is selected from a number of available breast cup sizes, (d) said inner surface of said first breast cup and said inner surface of said second breast cup are different breast cup sizes, (e) said outer surface of said first breast cup and said outer surface of said second breast cup are the same breast cup size, (f) said first breast cup is removably inserted in said first slot, (g) said second breast cup is removably inserted in said second slot, (h) said first slot and said second slot each comprise an opening bordered by and between a top flap and a bottom flap and (i) said top flap and said bottom flap do not cover an entirety of said inner surface of a respective one of said first breast cup and said second breast cup.

3. The breast apparatus according to claim 2, wherein said top flap and said bottom flap each comprise a pocket made of fabric, said pocket for covering said inner surface of a respective one of said first breast cup and said second breast cup.

4. The breast apparatus according to claim 2, wherein said top flap and said bottom flap each include an adherent.

5. The breast apparatus according to claim 4, wherein said adherent comprises at least one of (i) a hook and loop fastener, (ii) glue and (iii) an adhesive tape.

6. The breast apparatus according to claim 4, wherein (i) said first breast cup and said second breast cup each include a breast cup adherent and (ii) said breast cup adherent is implemented to attach to said adherent of at least one of said top flap and said bottom flap.

7. The breast apparatus according to claim 2, wherein said first slot and said second slot each comprise a pocket.

8. A breast apparatus comprising:

a breast covering garment comprising a first slot and a second slot; and a plurality of breast cups each comprising (i) an inner surface having a concave shape and (ii) an outer surface having a convex shape, wherein (a) said concave shape and said convex shape are each selected from a number of standard breast cup sizes, (b) a first of said plurality of breast cups is removably inserted in said first slot, (c) a second of said plurality of breast cups is removably inserted in said second slot, (d) a wearer selects at least one of said number of stantard breast cup sizes, (e) said first slot and said second slot each comprise an opening bordered by and between a top flap and a bottom flap and (f) said top flap and said bottom flap do not cover an entirety of said inner surface of said plurality of breast cups.

9. The breast apparatus according to claim 8, wherein said first slot and said second slot each comprise an opening, a top flap and a bottom flap.

10. The breast apparatus according to claim 9, wherein said top flap and said bottom flap each comprise a pocket made of fabric, said pocket for covering said inner surface of one of said plurality of breast cups.

11. The breast apparatus according to claim 9, wherein said top flap and said bottom flap each comprise an adherent.

12. The breast apparatus according to claim 11, wherein said adherent comprises at least one of (i) a hook and loop fastener, (ii) glue and (iii) an adhesive tape.

13. The breast apparatus according to claim 11, wherein (i) each of said plurality of breast cups include a breast cup adherent and (ii) said breast cup adherent is implemented to attach to said adherent of at least one of said top flap and said bottom flap.

* * * * *